United States Patent [19]

Lewtas et al.

[11] Patent Number: 5,011,505

[45] Date of Patent: Apr. 30, 1991

[54] FLOW IMPROVERS AND CLOUD POINT DEPRESSANTS

[75] Inventors: Kenneth Lewtas; Jacqueline D. Bland, both of Wantage, United Kingdom

[73] Assignee: Exxon Chemical Patents Inc., Linden, N.J.

[21] Appl. No.: 239,788

[22] Filed: Sep. 1, 1988

[30] Foreign Application Priority Data

Sep. 2, 1987 [GB] United Kingdom ..... 8720606

[51] Int. Cl.[5] ..... C10L 1/18

[52] U.S. Cl. ..... 44/393; 252/56 R

[58] Field of Search ..... 44/62, 70; 252/56 R

[56] References Cited

U.S. PATENT DOCUMENTS

| | | | |
|---|---|---|---|
| 2,600,449 | 6/1952 | VanHorne et al. . | |
| 4,175,926 | 11/1979 | Wisotsky . | |
| 4,261,703 | 4/1981 | Tack et al. | 44/62 |
| 4,419,106 | 12/1983 | Miller | 44/62 |
| 4,661,122 | 4/1987 | Lewtas | 44/62 |
| 4,670,516 | 6/1987 | Sackmann et al. . | |
| 4,713,088 | 12/1987 | Tack et al. | 44/62 |
| 4,839,074 | 6/1989 | Rossi et al. | 252/66 |

FOREIGN PATENT DOCUMENTS

| | | |
|---|---|---|
| 0153177 | 8/1985 | European Pat. Off. . |
| 0214786A1 | 3/1987 | European Pat. Off. . |
| 0225688 | 6/1987 | European Pat. Off. . |
| 1235693 | 5/1960 | France . |
| 2131111 | 11/1972 | France . |
| 2309583 | 11/1976 | France . |
| 915602 | 1/1963 | United Kingdom . |
| 1080910 | 8/1967 | United Kingdom . |
| 1446219 | 8/1976 | United Kingdom . |

*Primary Examiner*—Jacqueline V. Howard

*Attorney, Agent, or Firm*—Robert A. Maggio; Vivienne T. White

[57] ABSTRACT

Additives suitable for improving the flow and/or depressing the cloud point of crude oils, lubricating oils and especially fuel oils are polymers containing defined alkyl groups of at least 8 carbon atoms chain length. Such polymers are either (a) of a mixture of monomers having only two alkyl groups being at least 3 carbon atoms longer than the other or (b) of a mixture of monomers having only three alkyl groups each differing by at least 3 carbon atoms and the middle alkyl group being half the combined length of the other two. Alternatively, the polymer may be derived from a monomer having the two defined alkyl groups (a) or the three defined alkyl groups (b).

24 Claims, No Drawings

FLOW IMPROVERS AND CLOUD POINT DEPRESSANTS

This invention relates to flow improves and cloud point depressants especially for fuel oils, particularly distillate fuel oils Various cloud point depressants (i.e. additives which delay the onset of crystallisation of wax in the fuel oil as the temperature decreases) have been proposed and they have been effective However, it has been found that when they are used in conjunction with flow improvers in fuel oils, the properties of the flow improver are impaired.

We have now discovered cloud point depressants for fuel oils which not only act as effective cloud point depressants but which do not substantially impair the properties of other flow improvers which might also be added to the fuel oil.

Also the polymers of this invention are potent distillate fuel flow improvers when used alone or in combination with other known additives. It is considered that their use extends to fuels and oils where wax precipitates from solution as the ambient temperature drops and causes flow problems e.g. in jet fuel, kerosene, diesel and heating fuels, fuel oils, crude oils and lubricating oils. They also act as wax crystal modifiers to alter the sizes and shapes of the wax crystals thus improving the low temperature flow properties of the fuel or oil (e.g. as measured by the Cold Filter Plugging Point (CFPP) test IP 309/80). They can also act to inhibit the temperature at which the wax starts to crystallise (e.g. as measured by the Cloud Point test, IP 219 ASTM D2500).

According to this invention a cloud point depressant and/or flow improver comprises either (1) a polymer derived from either a mixture of (a) monomers having an alkyl group of at least 8 carbon atoms of substantially only two different chain lengths, one being at least 3 carbon atoms longer than the other, or (b) monomers having an alkyl group of at least 8 carbon atoms of substantially only three different chain lengths, these chain lengths differing by at least 3 carbon atoms or (2) a polymer derived either (c) from a monomer having substantially only two alkyl groups of at least 8 carbon atoms, one being at least 3 carbon atoms longer than the other or (d) from a monomer having substantially only three alkyl groups of at least 8 carbon atoms, the chain lengths of each alkyl group differing by at least 3 carbon atoms from each other alkyl group.

It is essential that if any of the defined alkyl groups is branched the branching must be not more than one methyl branch per alkyl group.

We prefer that when the polymer is derived from a monomer having 3 alkyl groups the chain length of the intermediate chain length alkyl group is half the sum of the chain lengths of the shortest and longest alkyl groups.

The polymers which act upon the wax as described herein may be described as "comb" polymers, viz polymers having alkyl side-chains hanging from the backbone. As the polymers of the invention include the mixing of two side-chains on the same polymer these side chains may be incorporated by mixing prior to monomer formation (e.g. a monomer may contain both side-chains) or the monomer mixture may be formed by mixing the monomers each of an individual side-chain length.

Also this invention provides the use for depressing the cloud point of and/or improving the flow of a fuel oil of either (1) a polymer derived from a mixture of (a) monomers having an alkyl group of at least 8 carbon atoms of substantially only two different chain lengths, one being at least 3 carbon atoms longer than the other, or (b) monomers having an alkyl group of at least 8 carbon atoms of substantially only three different chain lengths, these chain lengths differing by at least 3 carbon atoms or (2) a polymer derived either (c) from a monomer having substantially only two alkyl groups of at least 8 carbon atoms, one being at least 3 carbon atoms longer than the other or (d) from a monomer having substantially only three alkyl groups of at least 8 carbon atoms, the chain lengths of each alkyl group differing by at least 3 carbon atoms from each other alkyl group.

It is essential that if any of the defined alkyl groups is branched the branching must be not more than one methyl branch per alkyl group.

Here again we prefer that when the polymer is derived from a monomer having only 3 alkyl groups the chain length of the intermediate alkyl group is half the sum of the chain lengths of the shortest and longest alkyl groups.

By substantially only two alkyl groups or substantially only three alkyl groups we mean that at least 90% of the alkyl groups should be as defined.

A wide variety of polymer mixtures or of polymers may be used provided they have the defined number and size of alkyl groups Thus for example one may use polymer mixtures of di-alkyl fumarate-vinyl acetate, alkyl itaconate-vinyl acetate co-polymers or polymers of alkyl itaconates, alkyl acrylates, alkyl methacrylates and alpha olefins. It can be seen that a "spacer" group (e.g. vinyl acetate) may be inserted into the polymer and these groups do not have the chain length restrictions defined above.

The defined alkyl groups in the monomer mixture or polymer must contain a minimum of 8 carbon atoms. Preferably they have between 10 and 20 carbon atoms and suitable pairs are $C_{10}$, $C_{14}$ and $C_{18}$, $C_{12}$ and $C_{16}$, and $C_{14}$ and $C_{18}$. Suitable trios are $C_{10}$, $C_{14}$ and $C_{18}$, $C_{11}$, $C_{14}$ and $C_{17}$, $C_{12}$, $C_{15}$ and $C_{18}$. The alkyl groups are preferably n-alkyl groups, but if desired branched alkyl groups can be used. If branched side chains are used then only a single methyl branch may be used, e.g. in the 1 or 2 position, off the main backbone, e.g. 1-methyl hexadecyl.

It is preferred that the difference in the chain length of the pairs of alkyl groups is at least 5, especially for polymers of monomers having two or three different alkyl groups.

The number average molecular weights of the polymers in the polymer mixture and of the polymers can vary but usually they lie between 1000 and 500,000 preferably between 2000 and 100,000 as measured by Gel Permeation chromotography A typical polymer is a copolymer containing 25 to 100 wt %, preferably about 50 wt. %, of a dicarboxylic acid and 0 to 75 wt. % preferably about 50 wt. % of an alpha olefin or of another unsaturated ester such as a vinyl ester and/or an alkyl acrylate or methacrylate. Homopolymers of di-n-alkyl fumarates or copolymers of a di-n-alkyl fumarates and vinyl acetate are particularly preferred.

The monomers (e.g. carboxylic acid esters) useful for preparing the preferred polymer can be represented by the general formula $R_5$:

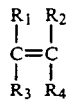

wherein $R_1$ and $R_2$ are hydrogen or a $C_1$ to $C_4$ alkyl group, e.g. methyl, $R_3$ is $R_5$, $COOR_5$, $OCOR_5$ or $OR_5$, $R_4$ is $COOR_3$, hydrogen or a $C_1$ to $C_4$ alkyl group, preferably $COOR_3$ and $R^5$ is $C_1$ to $C_{22}$ alkyl or $C_1$ to $C_{22}$ substituted aryl group. These may be prepared by esterifying the particular mono- or di-carboxylic acid with the appropriate alcohol or mixture of alcohols.

Examples of other unsaturated esters which can be copolymerized are the alkyl acrylates and methacrylates. The dicarboxylic acid mono or di-ester monomers may be copolymerised with various amounts, e.g. 5 to 75 mole %, of other unsaturated esters or olefins. Such other esters include short chain alkyl esters having the formula:

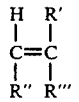

where R′ is hydrogen or a $C_1$ to $C_4$ alkyl group, R″ is —COOR″″ or —OCOR″″ where R″″ is a $C_1$ to $C_5$ alkyl group branched or unbranched, and R‴ is R″ or hydrogen Examples of these short chain esters are methacrylates, acrylates, the vinyl esters such as vinyl acetate and vinyl propionate being preferred More specific examples include methyl methacrylate, isopropenyl acetate and butyl and isobutyl acrylate Our preferred copolymers contain from 40 to 60 mole % of a dialkyl fumarate and 60 to 40 mole % of vinyl acetate where the alkyl groups of the dialkyl fumarate are as defined previously.

Where ester polymers or copolymers are used they may conveniently be prepared by polymerising the ester monomers in a solution of a hydrocarbon solvent such as heptane, benzene, cyclohexane, or white oil, at a temperature generally in the range of from 20° C. to 150° C. and usually promoted with a peroxide or azo type catalyst, such as benzoyl peroxide or azo diisobutyronitrile, under a blanket of an inert gas such as nitrogen or carbon dioxide, in order to exclude oxygen.

Specific examples of suitable pairs of monomers are di-dodecyl fumarate and di-octadecyl fumarate; di-tridecyl fumarate and di-nonadecyl fumarate; styrene-with didodecyl maleate and di-octadecyl maleate; di-tridecyl itaconate and di octadecyl itaconate; di-tetradecyl itaconate and di-octadecyl itaconate′ di-dodocyl itaconate and dioctadecyl itaconate; tetradecyl itaconate and dieicosyl itaconate; decyl acrylate and hexadecyl acrylate; tridecyl acrylate and nonadecyl acrylate; decyl methacrylate and octadecyl methacrylate; 1-dodecene and 1-hexadecene; 1 tetradecene and 1-octadecene. The above monomer pairs may be polymerised together with spacer monomers such as vinyl acetate.

As alternatives to the dialkyl compounds above one could use the mono alkyl equivalents; e g poly mono dodecyl fumarate and mono-octadecyl fumarate.

Specific examples of suitable trios of monomers are didodecyl fumarate; dipentadecyl fumarate and dioctadecyl fumarate; didecyl fumarate, ditetradecyl fumarate and di-octadecyl fumarate with vinyl acetate; didecyl maleate, di-tetradecyl maleate and di octadecyl maleate with styrene; di-tridecyl itaconate di-hexadecyl itaconate, and di-nonadecyl itaconate; with vinyl acetate; didodecyl itaconate, dihexadecyl itaconate and dieicosyl itaconate; decyl acrylate, pentadecyl acrylate and eicosyl acrylate; dodecyl methacrylate, hexadecyl methacrylate and eicosyl methacrylate; 1-dodecene, 1-pentadecene and 1-octadecene Specific examples of suitable polymers with three different alkyl groups are n-decyl, n-tetradecyl, n-octadecyl fumarate-vinyl acetate copolymer.

Polymers with two different or three different alkyl groups can conveniently be prepared by using a mixture of alcohols of the appropriate chain lengths when esterifying the acid or alkylating a benzene ring for example.

In general it is preferred to use a dialkyl fumarate-vinyl acetate copolymer or a polydialkyl fumarate, in particular didecyl fumarate dioctadecyl fumarate-vinyl acetate copolymer; didodecyl fumarate-dihexadecyl fumarate dihexadecyl fumarate-vinyl acetate copolymer; dodecyl, hexadecyl fumarate-vinyl acetate copolymer; polydidecyl fumarate and dioctadecyl fumarate; polydodecyl dihexadecyl fumarate; poly dodecyl, hexadecyl fumarate Examples of polyalpha olefins are copoly(dodecene, eicosene) and copoly (tetradecene, octadecene).

The additives of this invention can be added to a fuel oil, e.g. a liquid hydrocarbon fuel oil. The liquid hydrocarbon fuel oils can be distillate fuel oils, such as the middle distillate fuel oils, e.g. a diesel fuel, aviation fuel, kerosene, fuel oil, jet fuel, heating oil, etc. Generally, suitable distillate fuels are those boiling in the range of 120° C. to 500° C. (ASTM D86), preferably those boiling in the range 150° C. to 400° C., e.g. distillate petroleum fuel oils boiling in the range 120° C. to 500° C., or a distillate fuel whose 90% to final boiling point range is 10° to 40° C. and whose Final Boiling Point is in the range 340° C. to 400° C. Heating oils are preferably made of a blend of virgin distillate, e.g. gas oil, naphtha, etc. and cracked distillates, e.g. catalytic cycle stock. Alternatively, they can be added to crude oils or lubricating oils.

The additives are added in minor proportion by weight preferably in an amount of from 0.0001 to 0.5 wt. %, preferably 0.001 to 0.2 wt. % especially 0.01 to 0.05 wt. % (active matter) based on the weight of the fuel oil.

Improved results are often achieved when the fuel compositions to which the additives of this invention have been added incorporate other additives known for improving the cold flow properties of distillate fuels generally. Examples of these other additives are the polyoxyalkylene esters, ethers, ester/ethers, amide/esters and mixtures thereof, particularly those containing at least one, preferably at least two C10 to $C_{30}$ linear saturated alkyl groups of a polyoxyalkylene glycol of molecular weight 100 to 5,000 preferably 200 to 5,000, the alkyl group in said polyoxyalkylene glycol containing from 1 to 4 carbon atoms. European Patent Publication 0,061,895 A2 describes some of these additives.

The preferred esters, ethers or ester/ethers may be structurally depicted by the formula:

$$R^5—O—(A)—O—R^6$$

where $R^5$ and $R^6$ are the same or different and may be

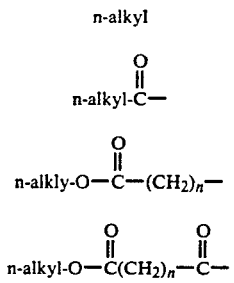

(i) n-alkyl (ii) n-alkyl-C(=O)—

(iii) n-alkly-O—C(=O)—$(CH_2)_n$—

(iv) n-alkyl-O—C(=O)$(CH_2)_n$—C(=O)— the alkyl group being linear and saturated and containing 10 to 30 carbon atoms, and A represents the polyoxyalkylene segment of the glycol in which the alkylene group has 1 to 4 carbon atoms, such as polyoxymethylene, polyoxyethylene or polyoxytrimethylene moiety which is substantially linear; some degree of branching with lower alkyl side chains (such as in polyoxypropylene glycol) may be tolerated but it is preferred the glycol should be substantially linear.

Suitable glycols generally are the substantially linear polyethylene glycols (PEG) and polypropylene glycols (PPG) having a molecular weight of about 100 to 5,000, preferably about 200 to 2,000. Esters are preferred and fatty acids containing from 10–30 carbon atoms toms are useful for reacting with the glycols to form the ester additives and it is preferred to use a $C_{18}$–$C_{24}$ fatty acid, especially behenic acids. The esters may also be prepared by esterifying polyethoxylated fatty acids or polyethoxylated alcohols A particularly preferred additive of this type is polyethylene glycol dibehenate, the glycol portion having a molecular weight of about 600 and is often abbreviated as PEG 600 dibehenate.

Other suitable additives to be used with the cloud depressants of this invention are ethylene unsaturated ester copolymer flow improvers. The unsaturated monomers which may be copolymerised with ethylene include unsaturated mono and diesters of the general formula:

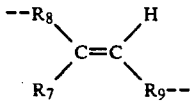

wherein $R_8$ is hydrogen or methyl, $R_7$ is a —$OOCR_{10}$ group wherein $R_{10}$ is hydrogen or a $C_1$ to $C_{28}$, more usually $C_1$ to $C_{17}$, and preferably $C_1$ to $C_8$, straight or branched chain alkyl group; or $R_7$ is a —$COOR_{10}$ group wherein $R_{10}$ is as previously defined but is not hydrogen and $R_9$ is hydrogen or —$COOR_{10}$ as previously defined. The monomer, when $R_7$ and $R_9$ are hydrogen and $R_8$ is —$OOCR_{10}$, includes vinyl alcohol esters of $C_1$ to $C_{29}$, more usually $C_1$ to $C_{29}$, more usually $C_1$ to $C_{18}$, monocarboxylic acid, and preferably $C_2$ to $C_{29}$, more usually $C_1$ to $C_{18}$, monocarboxylic acid, and preferably $C_2$ to $C_5$ monocarboxylic acid. Examples of vinyl esters which may be copolymerised with ethylene include vinyl acetate, vinyl propionate and vinyl butyrate or isobutyrate, vinyl acetate being preferred, it is also preferred that the copolymers contain from 20 to 40 wt. % of the vinyl ester, more preferably from 25 to 35 wt. % vinyl ester. They may also be mixtures of two copolymers such as those described in U.S. Pat. No. 3,961,916. It is preferred that these copolymers have a number average molecular weight as measured by vapour phase osmometry of 1,000 to 6,000, preferably 1,000 to 3,000.

Other suitable additives to be used with the additives of the present invention are polar compounds, either ionic or non-ionic, which have the capability in fuels of acting as wax crystal growth inhibitors. Polar nitrogen containing compounds have been found to be especially effective when used in combination with the glycol esters, ethers or ester/ethers. These polar compounds are generally amine salts and/or amides formed by reaction of at least one molar proportion of hydrocarbyl substituted amines with a molar proportion of hydrocarbyl acid having 1 to 4 carboxylic acid groups or their anhydrides; ester/amides may also be used containing 30 to 300, preferably 50 to 150 total carbon atoms. These nitrogen compounds are described in U.S. Pat. No. 4,211,534. Suitable amines are usually long chain $C_{21}$–$C_{40}$ primary, secondary, tertiary or quaternary amines or mixtures thereof but shorter chain amines may be used provided the resulting nitrogen compound is oil soluble and therefore normally containing from 30 to 300 total carbon atoms. The nitrogen compound preferable contains at least one straight chain $C_8$–$C_{40}$, preferably $C_{14}$ to $C_{24}$ alkyl segment.

Suitable amines include primary, secondary, tertiary or quaternary, but preferably are secondary. Tertiary and quaternary amines can only form amine salts. Examples of amines include tetradecyl amine, cocoamine, hydrogenated tallow amine and the like. Examples of secondary amines include dioctadecyl amine, methylbehenyl amine and the like. Amine mixtures are also suitable and many amines derived from natural materials are mixtures. The preferred amine is a secondary hydrogenated tallow amine of the formula $HNR_1R_2$ wherein $R_1$ and $R_2$ are alkyl groups derived from hydrogenated tallow fat composed of approximately 4% $C_{14}$, 31% $C_{16}$, 59% $C_{18}$.

Examples of suitable carboxylic acids for preparing these nitrogen compounds (and their anhydrides) include cyclo-hexane 1,2 dicarboxylic acid, cyclohexane dicarboxylic acid, cyclopentane 1,2 dicarboxylic acid, naphthalene dicarboxylic acid and the like.

Generally, these acids will have about 5–13 carbon atoms in the cyclic moiety. Preferred acids are benzene dicarboxylic acids such as phthalic acid, terephthalic acid, and iso-phthalic acid. Phthalic acid or its anhydride is particularly preferred. The particularly preferred compounds is the amide-amine salt formed by reacting 1 molar portion of phthalic anhydride with 2 molar portions of di-hydrogenated tallow amine. Another preferred compound is the diamide formed by dehydrating this amide-amine salt.

The relative proportions of additives used in the mixtures are preferably from 0.05 to 20 parts by weight, more preferably from 0.1 to 5 parts by weight of the additive of the invention to 1 part of the other additives such as the polyoxyalkylene esters, ether or ester/ether or amide-ester.

The additive of the invention may conveniently be dissolved in a suitable solvent to form a concentrate of from 20 to 90, e.g. 30 to 80 wt % of the polymer in the solvent. Suitable solvents include kerosene, aromatic naphthas, mineral lubricating oils etc.

EXAMPLE 1

In this Example three additives according to this invention were used. The first (CDI) was a copolymer of 50% molar n-decyl, n-octadecyl fumarate and 50% molar vinyl acetate, the number average molecular weight being 35,000. The second addition (CD2) was a copolymer of 50% molar, n-dodecyl, n-hexadecyl fumarate and 50% molar of vinyl acetate, the number average molecular weight being 35,000. The third additive (CD3) was a copolymer of a mixture of 25% molar of n-didodecyl fumarate, 25% molar of n-dihexadecyl fumarate and 50% molar of vinyl acetate, the fumarates being mixed after esterification. The number average molecular weight of the copolymer was 31,200.

When added to various fuels each additive was blended in a 1:4 weight ratio with a flow improver K consisting of a mixture of ethylene/vinyl acetate copolymers. This mixture of ethylene/vinyl acetate copolymers is a 3:1 weight mixture of an ethylene/vinyl acetate copolymer containing 36% vinyl acetate of number average molecular weight about 2000 and an ethylene/vinyl acetate copolymer containing 13 wt % vinyl acetate of number average molecular weight about 3000.

To test the effectiveness of the additives as flow improvers and cloud point depressants they were added at a concentration of 0.010 to 0.0625 weight per cent (active matter) to seven different fuels A to G having the following characteristics:

| | | | | | ASTM-D86 Distillation | | | | |
|---|---|---|---|---|---|---|---|---|---|
| | WAT | CP | CFPP | IBP | 20% | 50% | 80% | 90% | FBP |
| A | 1 | 2 | 1 | 184 | 270 | 310 | 338 | 350 | 369 |
| B | 2 | 6 | 2 | 173 | 222 | 297 | 342 | 356 | 371 |
| C | −6 | 0 | −3 | 190 | 246 | 282 | 324 | 346 | 374 |
| D | 1 | 4 | −3 | 202 | 263 | 297 | 340 | 360 | 384 |
| E | −1 | 1 | −1 | 176 | 216 | 265 | 318 | 340 | 372 |
| F | 0 | 3 | 0 | 188 | 236 | 278 | 326 | 348 | 376 |
| G | 0 | 3 | 0 | 184 | 226 | 272 | 342 | 368 | 398 |

The fuel alone and then containing the additives were subjected to the cold filter plugging point test and differential scanning calorimetry, details of which are as follows:

The Cold Filter Plugging Point Test (CFPPT)

The cold flow properties of the blend were determined by the Cold Filter Plugging Point Test (CFPPT). This test is carried out by the procedure described in detail in "Journal of the Institute of Petroleum", Vol. 52, No. 510, June 1966 pp.173–185. In brief, 1 40 ml. sample of the oil to be tested is cooled by a bath maintained at about −34° C. Periodically (at each one degree Centrigrade drop in temperature starting from 2° C. above the cloud point) the cooled oil is tested for its ability to flow through a fine screen in a time period. This cold property is tested with a device consisting of a pipette to whose lower end is attached an inverted funnel positioned below the surface of the oil to be tested. Stretched across the mouth of the funnel is a 350 mesh screen having an area of about 0.45 square inch. The periodic tests are each initiated by applying a vacuum to the upper end of the pipette whereby oil is drawn through the screen up into the pipette to a mark indicating 20 ml. of oil. The test is repeated with each one degree drop in temperature until the oil fails to fill the pipette within 60 seconds. The results of the test are quoted as CFPP (° C.) which is the difference between the fail temperature of the untreated fuel ($CFPP_o$) and the fuel treated with the flow improver ($CFPP_1$) i.e. $\Delta CFPP = CFPP_o - CFPP_1$.

In the DSC (Differential Scanning Calorimetry) the Δ WAT (Wax Appearance Temperature) in °C. is measured this being the difference between the temperature at which wax appears for the base distillate fuel alone ($WAT_o$) and the temperature at which wax appears for the treated distillate fuel oil ($WAT_1$) when a 25 microlitre sample is cooled in the calorimeter at 2° C./minute, i.e. $\Delta WAT = WAT_o - WAT_1$.

The instrument used in these studies was a Metler TA2000 B. It has been found that the Δ WAT correlates with the depression of the Cloud Point.

Also determined was the CFPP regression which is the difference in the $CFPP_1$ between the fuel treated with flow improver alone (eg polymer mixture K) and the fuel treated with the flow improver (e.g. polymer mixture K) and cloud point depressant. It will be appreciated that the smaller the CFPP regression the less the cloud depressant impairs the properties of the flow improver. CFPP reg=CFPP (flow improver K)−CFPP (cloud point depressant). A negative CFPP regression means that the CFPP has been improved.

The Δ CFPP and the CFPP regression were determined twice for each fuel and the average result is quoted.

The results obtained were as follows

| | | CD1 | | | CD2 | | | CD3 | | |
|---|---|---|---|---|---|---|---|---|---|---|
| FUEL | Concentration ppm (ai) | ΔCFPP | CFPP reg | ΔWAT | ΔCFPP | CFPP reg | ΔWAT | ΔCFPP | CFPP reg | ΔWAT |
| A | 300/500 | 2,5 | 11,9 | 2.1 | 3,12 | 10,2 | 1.9 | 3,13 | 10,1 | 1.6 |
| B | 300/500 | 2,4 | 8,8 | 2.0 | 5,9 | 5,3 | 1.0 | 3,10 | 7,2 | 1.5 |
| C | 100/500 | 11,15 | 0,3 | 2.2 | 13,17 | −2,0 | 2.0 | 12,17 | −1,0 | 1.2 |
| D | 300/500 | 13,14 | 0,0 | 3.1 | 14,15 | −1,−1 | 2.3 | 13,14 | 0,0 | 2.5 |
| E | 300/500 | 11,12 | 1,3 | 1.5 | 11,13 | 1,2 | 1.0 | 13,13 | −1,2 | 1.3 |
| F | 375/625 | 13,15 | 1,0 | 2.7 | 15,17 | −1,−2 | 1.3 | 14,14 | 0,1 | 1.1 |
| G | 175/300 | 17,18 | −14,−14 | 4.3 | 20,21 | −17,−17 | 2.2 | 22,22 | −19,−18 | 2.8 |

For comparison purposes the same tests were carried out on the same fuels but using instead of CD1, CD2 and CD3 three dialkyl fumarate/vinyl acetate copolymers X, Y and Z which were respectively ditetradecyl fumarate/vinyl acetate copolymers, di ($C_{14}/C_{16}$ alkyl) fumarate/vinyl acetate copolymer where the alcohols were mixed prior to esterification with the fumaric acid and di hexadecyl fumarate/vinyl acetate copolymer In each copolymer the amount of vinyl acetate was 50 mole percent and the number average molecular weights of the copolymers were about 4,200 weight average molecular weight.

| FUEL | Concentration ppm (ai) | X ΔCFPP | X CFPP reg | X ΔWAT | Y ΔCFPP | Y CFPP reg | Y ΔWAT | Z ΔCFPP | Z CFPP reg | Z ΔWAT |
|---|---|---|---|---|---|---|---|---|---|---|
| A | 300/500 | 13,13 | 0,2 | 0.6 | 3,3 | 10,12 | 1.8 | 2,8 | 11,7 | 2.3 |
| B | 300/500 | 6,6 | 4,6 | 0.3 | 0,5 | 10,7 | 1.8 | 0,2 | 10,10 | 2.2 |
| C | 100/500 | 10,13 | 1,5 | 1.1 | 8,10 | 3,7 | 2.4 | 10,13 | 1,5 | 2.6 |
| D | 300/500 | 11,15 | 2,0 | 1.3 | 12,11 | 2,4 | 3.1 | 8,12 | 5,3 | 3.4 |
| E | 300/500 | 13,14 | 1,0 | 1.1 | 10,11 | 1,4 | 2.8 | 10,11 | 4,3 | 3.4 |
| F | 375/625 | 12,14 | 2,1 | 0.9 | 10,12 | 4,3 | 3.4 | 8,10 | 6,5 | 3.3 |
| G | 175/300 | 19,21 | −16,−17 | 1.2 | 18,19 | −15,−15 | 3.2 | 13,12 | −10,−8 | 4.5 |

It can be seen that generally the ΔCFPP, CFPP reg and ΔWAT are better for the cloud point depressants CD1, CD2 and CD3 of this invention compared with the previously known dialkyl fumarate/vinyl acetate copolymers X, Y and Z.

EXAMPLE 2

In this Example three polydialkyl fumarates CD4, CD5 and CD6 were used as flow improvers and cloud depressants.

CD4 was a poly(n-decyl/n-octadecyl) fumarate of number average molecular weight about 4200, CD5 was a poly(n-dodecyl/n-hexadecyl) fumarate of number average molecular weight about 3,300 and CD6 was a copolymer of a 1:1 molar mixture of di-n-dodecyl fumarate and di-n-hexadecyl fumarate, of number average molecular weight 4300.

The same flow improver as that used in Example 1 was also used (i.e. polymer mixture K) and each cloud depressant was blended in a 1:4 mole ratio with the flow improver.

To test the effectiveness of the cloud depressants in combination with the flow improver they were added at the same concentrations and to the same seven fuels A to G used in Example 1.

The fuel alone and then containing the additives were subjected to the cold filter plugging point test and differential screening calorimetry.

The results obtained were as follows:

For comparison the following polyfumarates were also tested in Fuel G

PF1 a poly (n-dodecyl/n-tetradecyl) fumarate

PF2 a poly n-tetradecyl fumarate and

PF3 a poly (n-tetradecyl/n-hexadecyl) fumarate.

| FUEL | Concentration ppm (ai) | CD4 ΔCFPP | CD4 CFPP reg | CD4 ΔWAT | CD5 ΔCFPP | CD5 CFPP reg | CD5 ΔWAT | CD6 ΔCFPP | CD6 CFPP reg | CD6 ΔWAT |
|---|---|---|---|---|---|---|---|---|---|---|
| A | 300/500 | 4,8 | 9,6 | 2.0 | 8,13 | 5,1 | 1.2 | 4,12 | 9,2 | 1.6 |
| B | 300/500 | 2,5 | 8,7 | 2.2 | 8,9 | 2,3 | 1.0 | 4,6 | 6,6 | 1.5 |
| C | 100/500 | 12,17 | −1,1 | 3.1 | 11,13 | 0,5 | 2.1 | 11,15 | 0,3 | 2.6 |
| D | 300/500 | 14,15 | −1,−1 | 3.0 | 12,12 | 1,2 | 1.9 | 11,14 | 2,0 | 2.3 |
| E | 300/500 | 12,13 | 0,2 | 2.4 | 11,11 | 1,4 | 1.4 | 12,12 | 0,3 | 2.0 |
| F | 375/625 | 14,14 | 0,1 | 3.2 | 11,13 | 3,2 | 1.8 | 12,12 | 2,3 | 2.6 |
| G | 175/300 | 16,20 | −13,−16 | 5.5 | 17,20 | −14,−16 | 2.6 | 18,20 | −15,−16 | 3.6 |
| | | PF1 | | | PF2 | | | PF3 | | |
| G | 175/300 | 14,19 | −11,15 | 0.4 | 19,20 | −16,16 | 1.3 | 18,20 | −15,16 | 4.1 |

In general the results are better than those obtained for the prior art additives X, Y and Z as shown in Example 1 and the products PF1, PF2 and PF3.

EXAMPLE 3

In this Example certain polyalphaolefins were prepared and tested for flow improver activity and cloud point depression when added to fuels A, C and G of Example 1. Also the flow improver of Example 1 was added to the fuels for some of the tests.

The polyalphaolefins were:

P: copoly(dodecene, eicosene)

Q: copoly(tetradecene, octadecene)

In each case the mole ratio of the two monomers was 1:1.

The tests were CFPP and DSC.

The results obtained were:

| FUEL A | | | | | |
|---|---|---|---|---|---|
| Flow improver K ppm | P ppm | Q ppm | CFPP(°C.) | | ΔCFPP(°C.) |
| | 300 | | −1 | +1 | 1 |
| | 500 | | −2 | −1 | 2 |
| 240 | 60 | | −2 | −1 | 2 |
| 400 | 100 | | −2 | −2 | 3 |
| | | 300 | 0 | −1 | 1 |
| | | 500 | −2 | −1 | 2 |
| 240 | | 60 | −2 | −1 | 2 |
| 400 | | 100 | −3 | −4 | 4 |
| Fuel alone | | | 0 | +1 | |
| DSC settings | 2° C./min Cooling Rate<br>20 uV fsd (full scale deflection)<br>kerosene as reference<br>25 ul sample<br>cooled +20 to −20° C. | | | | |

| | WAT °C. | ΔWAT °C. |
|---|---|---|
| Fuel A alone | −3.7 | |
| 500 ppm P | −6.6 | 2.9 |
| 500 ppm Q | −6.1 | 2.4 |

| FUEL C | | | | | |
|---|---|---|---|---|---|
| Flow improver K ppm | P ppm | Q ppm | CFPP(°C.) | | ΔCFPP(°C.) |
| | 100 | | −3 | −2 | −1 |
| | 500 | | −2 | −3 | −1 |
| 80 | 20 | | −7 | −6 | 3 |
| 400 | 100 | | −14 | −14 | 11 |
| | | 100 | −2 | 0 | −2 |
| | | 500 | −3 | −3 | 0 |
| 80 | | 20 | −13 | −12 | 9 |
| 400 | | 100 | −15 | −16 | 12 |
| Fuel alone | | | −4 | −3 | |
| DSC settings | 2° C./min Cooling Rate<br>20 uV fsd (full scale deflection)<br>kerosene as reference<br>25 ul sample | | | | |

-continued

| cooled +20 to −20° C. | | |
|---|---|---|
| | WAT °C. | WAT °C. |
| Fuel C alone | −6.0 | |
| 500 ppm P | −9.7 | 3.7 |
| 500 ppm Q | −9.6 | 3.6 |

| Flow improver K ppm | FUEL G P ppm | FUEL G Q ppm | CFPP(°C.) | | ΔCFPP(°C.) |
|---|---|---|---|---|---|
| | 175 | | −1 | 0 | 0 |
| | 300 | | −2 | −2 | 2 |
| 140 | 35 | | −15 | −17 | 16 |
| 240 | 65 | | −14 | −15 | 14 |
| | | 175 | −3 | −2 | 2 |
| | | 300 | −3 | −2 | 2 |
| 140 | | 35 | −21 | −20 | 20 |
| 240 | | 60 | −20 | −22 | 2 |
| Fuel G alone | | | 0 | 0 | |

Fuel G was also used to test more conventionally prepared polyalphaolefins.

For example:

R=poly-alpha tetradecene

S=poly-alpha hexadecene

T=poly-alpha octadecene

U=poly-alpha eicosane

The results for CFPP and WAT may be compared to the results from the polymers made according to this invention.

| Flow Improver K ppm | R ppm | S ppm | T ppm | U ppm | A CFPP(°C.) |
|---|---|---|---|---|---|
| | 175 | | | | −2 |
| | 300 | | | | 0 |
| 140 | 35 | | | | 17 |
| 240 | 65 | | | | 17 |
| | | 175 | | | 1 |
| | | 300 | | | 2 |
| 140 | | 35 | | | 17 |
| 240 | | 65 | | | 19 |
| | | | 175 | | −1 |
| | | | 300 | | 0 |
| 140 | | | 35 | | 13 |
| 240 | | | 65 | | 14 |
| | | | | 175 | 0 |
| | | | | 300 | −2 |
| 140 | | | | 35 | 13 |
| 240 | | | | 65 | 14 |

| DSC settings | 2° C./min Cooling Rate<br>20 uV fsd (full scale deflection)<br>kerosene as reference<br>25 ul sample<br>cooled +20 to −20° C. | |
|---|---|---|
| | WAT °C. | ΔWAT °C. |
| Fuel G alone | −0.6 | |
| 300 ppm P | −6.5 | 5.9 |
| 300 ppm Q | −4.7 | 4.1 |
| 300 ppm R | −0.1 | −0.5 |
| 300 ppm S | −3.4 | 2.8 |
| 300 ppm T | −0.3 | −0.3 |
| 300 ppm U | −0.6 | 0.0 |

In general the results obtained are better than those obtained for prior art additives X, Y and Z as shown in Exampl 1.

EXAMPLE 4

Two styrene maleate copolymers M and N were added at various concentrations to Fuel G of Example 1 as was the flow improver K. Copolymer M was a copolymer of an equimolar mixture of styrene and n-decyl, n-octadecyl maleate and copolymer N was a copolymer of an equimolar mixture of styrene and n-dodecyl, n-hexadecyl maleate.

The tests were CFPP and DSC.

The results obtained were:

| Flow improver K ppm | FUEL G M ppm | FUEL G N ppm | CFPP(°C.) | | ΔCFPP(°C.) |
|---|---|---|---|---|---|
| | 175 | | −2 | −2 | 2 |
| | 300 | | −4 | −5 | 4 |
| 140 | 35 | | −17 | −17 | 17 |
| 240 | 60 | | −20 | −19 | 19 |
| | | 175 | −1 | 0 | 0 |
| | | 300 | −1 | −3 | 2 |
| 140 | | 35 | −17 | −17 | 17 |
| 240 | | 60 | −19 | −20 | 19 |
| Fuel G alone | | | 0 | −1 | |

Fuel G was also used to test more conventionally prepared sytrene-maleate co-polymers. For example V=Styrene-di-n-decyl maleate co-polymer W=Styrene-di-n-dodecyl maleate co-polymer X=Styrene-di-n-tetradecyl maleate co-polymer Y=Styrene-di-n-hexadecyl maleate co-polymer Z=Styrene-d-di-n-octadecyl maleate co-polymer The results for ΔCFPP and ΔWAT may be compared to the results from co-polymers M and N. It can be seen that the best combination of results is generally achieved with the co-polymers from this invention.

| Flow Improver K ppm | V ppm | W ppm | X ppm | Y ppm | Z ppm | ΔCFPP (°C.) |
|---|---|---|---|---|---|---|
| | 300 | | | | | 0 |
| 240 | 60 | | | | | 11 |
| | | 300 | | | | 0 |
| 240 | | 60 | | | | 11 |
| | | | 300 | | | −1 |
| 240 | | | 60 | | | 14 |
| | | | | 300 | | 6 |
| 240 | | | | 60 | | 16 |
| | | | | | 300 | 1 |
| 240 | | | | | 60 | 6 |

| DSC settings | 2° C./min Cooling Rate<br>20 uV fsd (full scale deflection)<br>kerosene as reference<br>25 ul sample<br>cooled +20 to −20° C. | |
|---|---|---|
| | WAT °C. | WAT °C. |
| Fuel G alone | −0.7 | |
| 300 ppm M | −3.2 | 2.5 |
| 300 ppm N | −0.8 | 0.1 |
| 300 ppm V | −0.6 | −0.1 |
| 300 ppm W | −0.4 | −0.3 |
| 300 ppm X | −0.2 | −0.5 |
| 300 ppm Y | −3.7 | 3.0 |
| 300 ppm Z | −5.5 | 4.8 |

In general the results are better than those obtained for the prior art additives X, Y and Z as shown in Example 1.

We claim:

1. A cloud point depressant and flow improvement additive suitable for fuel oil, crude oil or lubricating oil comprising either (1) a polymer derived from either a mixture of (a) monomers derived from unsaturated dicarboxylic acid monomers having alkyl groups of at least 8 carbon atoms of substantially only two different chain lengths, one being at least 5 carbon atoms longer than the other, or (b) monomers having an alkyl group of at least 8 carbon atoms of substantially only three different chain lengths, these chain lengths differing by at least 5 carbon atoms or (2) a polymer derived either (c) from a monomer having substantially only two alkyl groups of at least 8 carbon atoms, one being at least 5 carbon atoms longer than the other or (d) from a monomer having substantially only three alkyl groups of at least 8 carbon atoms, the chain lengths of each alkyl group differing by at least 5 carbon atoms from each other alkyl group; optionally co-polymerized with a spaced monomer.

2. An additive according to claim 1 wherein the polymer is obtained from monomers having substantially only three alkyl groups and the chain length of the intermediate alkyl group is half the sum of the chain lengths of the shortest and longest alkyl groups.

3. An additive according to claim 1 wherien said alkyl groups have between 10 and 22 carbon atoms, preferably n-alkyl groups.

4. An additive according to claim 1 wherein the number average molecular weights of the polymer lies between 1000 and 500,000, as measured by Gel Permeation Chromatography.

5. An additive according to claim 1 wherein the polymer is a copolymer containing 25 to 100 weight % of a di-n alkyl ester of a dicarboxylic acid and 0 to 75 wt % of an olefin or of another unsaturated ester.

6. An additive according to claim 5 which is a homopolymer of a di-n alkyl fumarate or a copolymer thereof with vinyl acetate.

7. An additive according to claim 6 wherein the copolymer contains from 40 to 100 mole % of n di-n-alkyl fumarate and 60 to 0 mole% of vinyl acetate.

8. A composition comprising a crude oil, a fuel oil or a lubricating oil and a minor proportion by weight of an additive as in any of claims 1–8.

9. A composition according to claim 8, wherein the fuel oil is a distillate fuel boiling in the range of 120° C. to 500° C.

10. A composition according claim 8 wherein the amount of additive is 0.0001 to 0.5 wt %, preferably 0.001 to 0.2 wt % the active matter based on the weight of fuel oil.

11. A composition according to claim 8 which also includes a polyoxyalkylene ester, ether, ester/ether, amide/ester or a mixture thereof.

12. A composition according to claim 8 which also includes an ethylene unsaturated ester copolymer flow improver, preferably an ethylene-vinyl acetate copolymer.

13. A composition according to claim 8 which also includes a polar compound capable in fuels of acting as a wax crystal growth inhibitor.

14. A cloud point depressant and flow improvement concentrate comprising 10 to 80 weight percent of a solvent and 20 to 90 weight percent of either (1) a polymer derived from a mixture of (a) monomers derived from unsaturated dicarboxylic acid monomers having alkyl groups of at least 8 carbon atoms of substantially only two different chain lengths, one being at least 5 carbon atoms longer than the other, or (b) monomers having an alkyl group of at least 8 carbon atoms of substantially only three different chain lengths, these chain lengths differing by at least 5 carbon atoms or (2) a polymer derived either (c) from a monomer having substantially only two alkyl groups of at least 8 carbon atoms, one being at least 5 carbon atoms longer than the other or (d) from a monomer having substantially only three alkyl groups of at least 8 carbon atoms, the chain lengths of each alkyl group differing by at least 5 carbon atoms from each other alkyl group optionally copolymerized with a spaced monomer.

15. A concentrate according to claim 14 in which the polymer is derived from monomers having substantially only three alkyl groups and the chain length of the intermediate alkyl group is half the sum of the chain lengths of the shortest and longest alkyl groups.

16. A concentrate according to claim 14 wherein said alkyl groups have between 10 and 20 carbon atoms, preferably n-alkyl groups.

17. A concentrate according to claim 14 wherein the number average molecular weights of the polymer lies between, 1,000 and,500,000 as measured by Gel Permeation Chromatography.

18. A concentrate according to claim 14 wherein the polymer is a copolymer containing 25 to 100 wt % of a di-n-alkyl ester of a dicarboxylic acid and 75 to 0 wt % of an alpha olefin or of another unsaturated ester.

19. A concentrate according to claim 18 wherein the copolymer is a copolymer of a di-n-alkyl fumarate and vinyl acetate.

20. A concentrate according to claim 19 wherein the copolymer contains from 40 to 60 mole% of a di-n-alkyl fumarate and 60 to 40 mole% vinyl acetate.

21. A composition according to claim 1 wherein the polymer is a copolymer containing 25 to 100 weight percent of a di-N-alkyl ester of a dicarboxylic acid and 10 to 75 weight percent of an alpha olefin.

22. A composition according to cliam 13 wherein the polar compound is ionic.

23. A composition according to claim 13 wherein the polar compound is non-ionic.

24. The composition according to claim 13 wherein the polar compound is a polar nitrogen containing compound selected from amide or amine salts or mixtures thereof.

* * * * *